United States Patent [19]

Hardesty

[11] 4,379,609

[45] Apr. 12, 1983

[54] MODULAR CORD COUPLER JACK HAVING A DISCONNECTION ENCUMBRANCE

[75] Inventor: Edwin C. Hardesty, Perry Hall, Md.

[73] Assignee: Western Electric Company, Inc., New York, N.Y.

[21] Appl. No.: 241,951

[22] Filed: Mar. 9, 1981

[51] Int. Cl.[3] ..... H01R 13/639

[52] U.S. Cl. ..... 339/91 R; 339/176 M; 339/205

[58] Field of Search ..... 339/204, 205, 91 R, 339/176 M, 176 MP, 125 R, 126 R; 179/1 PC

[56] References Cited

U.S. PATENT DOCUMENTS

| | | | |
|---|---|---|---|
| 3,617,982 | 11/1971 | Hardesty | 339/91 R |
| 3,860,316 | 1/1975 | Hardesty | 339/91 R |
| 3,990,764 | 11/1976 | Krumreich | 339/176 M |
| 4,074,928 | 2/1978 | Johnston | 339/91 R |
| 4,148,539 | 4/1979 | Hardesty | 339/99 R |
| 4,153,327 | 5/1979 | Johnson | 339/205 |
| 4,166,881 | 9/1979 | Congdon et al. | 428/463 |
| 4,273,402 | 6/1981 | Hughes | 339/176 M |

*Primary Examiner*—John McQuade
*Attorney, Agent, or Firm*—E. W. Somers

[57] ABSTRACT

A telephone cord includes a length of cordage having each end terminated with a modular plug with the plug at one end disposed within a specially designed, easily identifiable cavity of a unipartite housing of a coupler jack of this invention. The coupler jack also includes a conventional plug-receiving cavity and a plurality of wire-like contact elements having retroflexed end portions which are positioned in the cavities to engage terminals of inserted plugs. The plug that is disposed within the specially designed cavity is held in such a manner that its disconnection from the coupler jack is encumbered to prevent withdrawal without the use of a mechanical expedient. Forces must be applied to a tab of the plug in a particular manner to cause the tab to assume an essentially linear rather than a conventional arched configuration which occurs when the free end of the tab is depressed. Also, the specially designed cavity is substantially deeper than the conventional cavity so that the inserted plug does not extend to the external surface to which the cavity opens. This prevents digital depression of the locking tab at its free end and the arching of the tab which in a conventional cavity permits withdrawal of the plug.

36 Claims, 17 Drawing Figures

MODULAR CORD COUPLER JACK HAVING A DISCONNECTION ENCUMBRANCE

TECHNICAL FIELD

This invention relates to a telephone cord having at least one of its ends connected to a coupler jack and, more particularly, to a coupler jack which preferably includes a unipartite housing for connecting electrically one end of a modular plug-terminated telephone cord to one end of another such cord.

BACKGROUND OF THE INVENTION

A present trend in the market of customer telephone station equipment is to provide a miniature or so-called modular jack at a wall outlet and in a base of a telephone set with a modular plug on each end of a line cord by which the base can be connected to the wall outlet. It is not uncommon to provide a wall jack in any number of rooms of a premises, for example, to allow a customer to connect and to disconnect telephone sets in accordance with service needs.

This trend has generated a demand for still greater mobility. For example, a customer may wish to place a telephone set at a particular location, but a wall outlet may not be near enough to permit connection with the initially provided line cord. Customers should welcome the opportunity to be able to easily relocate their telephone sets with customized lengths of line cords to extend from the sets to wall outlets. This capability would be similar to customer ability to place lamps or other electrical power consuming devices at desired locations in rooms and to connect them to remotely located outlets through extension cords.

A coupler for allowing the facile interconnection of modular plug-terminated telephone cords is disclosed and claimed in a pending commonly assigned application Ser. No. 06/081,604 which was filed on Oct. 3, 1979, in the name of E. C. Hardesty and which issued on May 19, 1981 as U.S. Pat. No. 4,268,109. That coupler includes two portions made of a dielectric material which when assembled to form a housing cooperate to hold a plurality of wire-like contact elements spaced apart to engage terminals of a modular plug that is inserted into each end of the coupler. While this device facilitates customer extension of telephone service, it does require the assembly of two plastic portions which increases the cost of manufacture.

While customer combinations of cords satisfies the desire for convenience and portability, it can lead to one problem which must be overcome. As is well known, most telephone cords are made by helically wrapping a plurality of tinsel ribbons about a center core and then insulating the ribbons. If the loop length from the wall terminal to the telephone and return is too lengthy, transmission characteristics will be affected because of excessive resistance. It has been recommended that the customer be allowed to use one twenty-five foot length of cordage comprising stranded conductors, which has a lower resistance the tinsel conductor cordage, in addition to the standard length line cord which is generally supplied with the telephone set. This restriction could be circumvented by the customer if couplers such as those in the above-identified Hardesty application were used.

Seemingly, the prior art is devoid of any device which may be used to satisfy these demands. What is needed is a device which provides the customer with flexibility in telephone set repositioning while preventing inadvertent connection of unacceptably high resistance cords by having a lock-in feature for securing one terminated end of a low resistance cord from facile withdrawal by a customer. The sought-after device is one having a unipartite housing which is relatively simple and inexpensive to manufacture and one which facilitates automatic manufacture.

SUMMARY OF THE INVENTION

The foregoing requirements are provided by a cord in accordance with this invention by which available length telephone cords having an overall maximum length in combination can be quickly and easily connected end-to-end as is necessary in a particular installation. If a wall outlet jack is positioned so that an existing line cord to a proposed telephone set location is of insufficient length, the telephone set is disconnected by removing the modular plug of the line cord from the wall jack. The disconnected plug of the line cord is inserted into one of two opposed cavities of the coupler jack of this invention, said coupler jack having a modular plug at one end of a stranded conductor line cord of a desired length inserted into its opposing cavity. The uncoupled end of the stranded conductor line cord is inserted into the jack in the wall outlet. On the other hand, if the telephone set has been positioned at a location extremely remote from a wall outlet by the use of a line cord in combination with a coupler jack of this invention, and it is desired to move the set closer to the outlet, the stranded conductor line cord is easily removed. The uncoupled end of that line cord is removed from the wall outlet and the end of the original line cord is unplugged from the coupler jack and inserted into the wall outlet.

A coupler jack for connecting telephone cords which are terminated with modular plugs includes a housing which is made of a dielectric material and which may be assembled from mating parts or which may be unipartite. The housing has a base and a top with walls extending therebetween to form an externally communicating plug-receiving cavity at each end and a plurality of spaced passageways that extend from one end to the other. A contact element in the form of a wire having a linear portion is received in each passageway so that the wires are mounted at a predetermined spacing. Each end portion of each wire is formed into a retroflexed configuration. The externally communicating cavity at each end of the coupler is adapted to receive a modular plug having terminals which engage aligned ones of retroflexed portions of the contact elements when the plug is inserted into one of the cavities. One of the cavities is arranged so that when a modular plug is inserted, the modular plug including a resilient locking tab is disposed completely within said one cavity to preclude digital depression of the tab by a customer. Further, the internal surfaces which define said one cavity are such that an inserted plug cannot be withdrawn without some form of mechanical assistance for causing the resilient tab to assume a predetermined configuration which is substantially linear and parallel to an underside of the plug body. This prevents inadvertent customer connection of excessive lengths of high resistance tinsel type cordage which could have adverse effects on the transmission characteristics of the customer loop.

BRIEF DESCRIPTION OF THE DRAWINGS

Other features of the present invention will be more readily understood from the following detailed description of specific embodiments thereof when read in conjunction with the accompanying drawings, in which.

DETAILED DESCRIPTION

Figure 1:
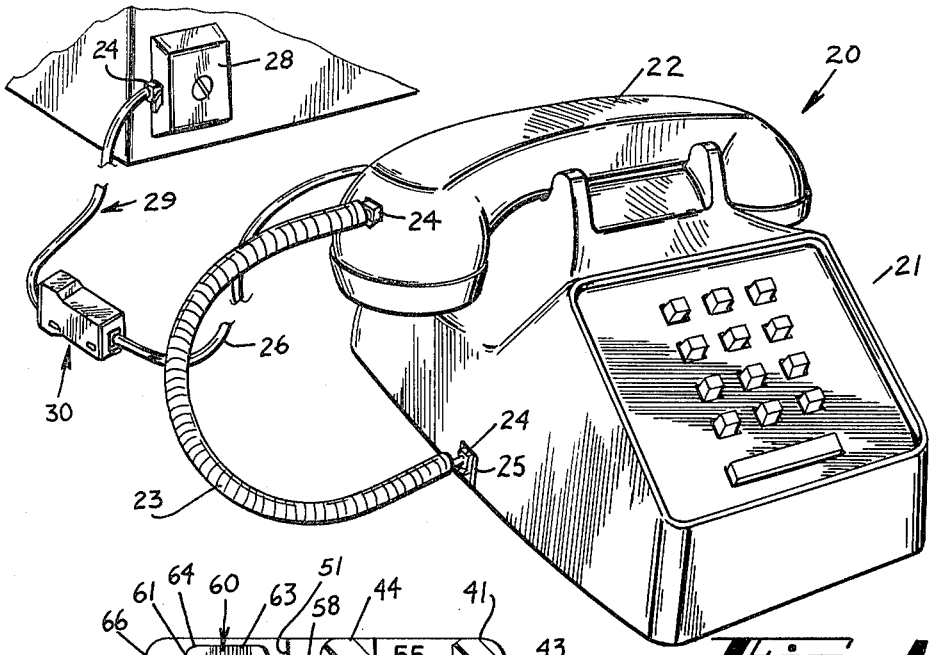
FIG. 1 is a perspective view in which a stranded conductor line cord from a wall outlet is connected to a line cord from a telephone set through a coupler jack made in accordance with this invention.

Referring now to FIG. 1, there is shown a telephone set 20 which includes a base 21 and a handset 22 that are interconnected by a retractile cord 23 having a modular plug 24 at each end received in jacks 25—25 in the base and in the handset. The modular plug 24 may be that shown, for example, in U.S. Pat. No. 4,148,359 which issued on Apr. 10, 1979 in the name of E. C. Hardesty while the jack may be that shown for example, in U.S. Pat. No. 3,990,764 which issued Nov. 9, 1976 in the name of C. L. Krumreich, both of which patents are incorporated by reference hereinto. A single line cord 26 having a modular plug 24 (see FIG. 2) at each end typically connects the base 21 to a jack 25 in a wall outlet 28 by plugs which are inserted into jacks 25—25 in the base and in the wall outlet.

Figure 4:
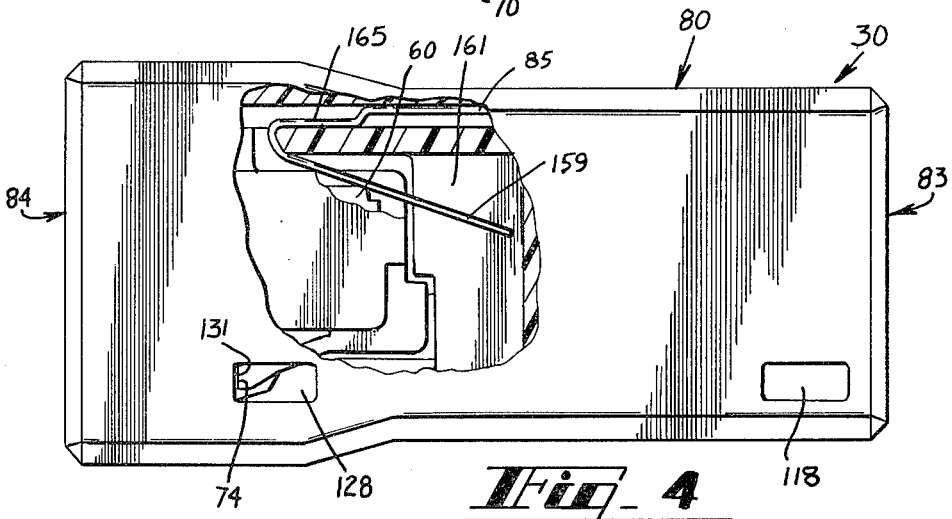
FIG. 4 is a side view of the coupler jack having a unipartite housing with an externally communicating cavity at each end of the coupler jack with a portion of the housing broken away to show a contact element engaging a terminal of an inserted plug.

The cord 26 which is terminated with the plug 24 is destined to be connected to a coupler jack 30 (see FIG. 4) of a cord 29 this invention. The cord 26 as well as the cord 29 includes a plurality of individually insulated relatively flexible conductors 36—36. Because of the cross-sectional configuration of the cord in which the conductors are disposed in a planar array, the cord is referred to as a "flat" cord. Each of the conductors of the cord 26 comprises a center nylon core 37 (see FIG. 2), a plurality of tinsel ribbons 38—38 which are wrapped spirally thereabout and an insulation cover. The conductors of the cord 29 are stranded in order to reduce the resistance in the customer loop.

Cordage from which the cords 26 and 29 are made includes a jacket which is made of a first plastic material and covered with a top coating of a second plastic material and which has an identification ridge. A cord having a top coating for strength properties is disclosed in U.S. Pat. No. 4,166,881 which issued on Sept. 4, 1979 in the names of W. I. Congdon, J. J. Mottine and William C. Vesperman and which is incorporated by reference hereinto.

Figure 2:
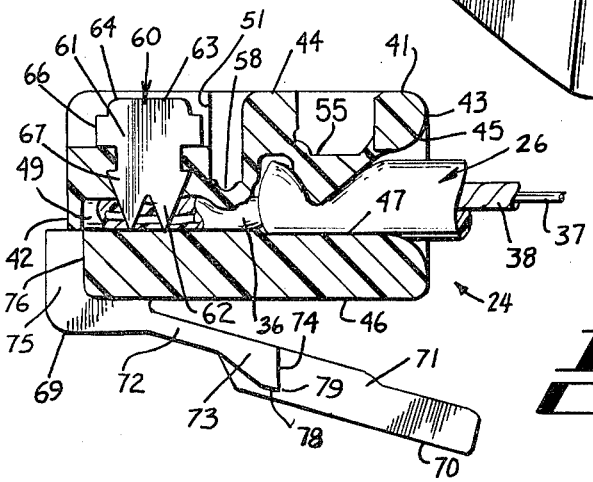
FIG. 2 is a side elevational view partially in section of a modular plug including a resilient tab which is adapted to be received in each end of a coupler jack of this invention.
Figure 3:
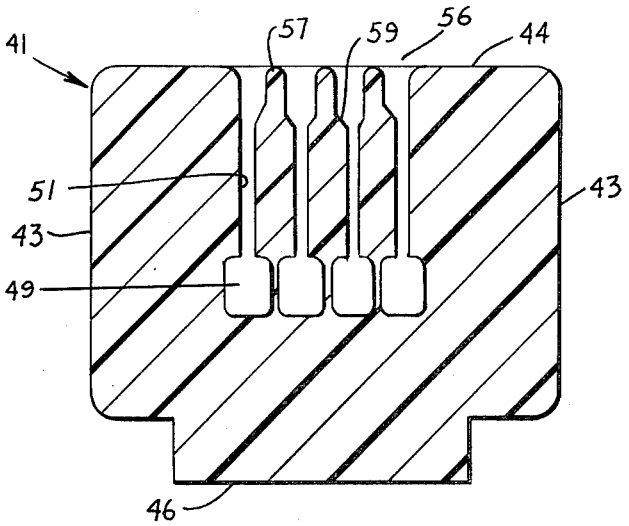
FIG. 3 is an end view of the modular plug of FIG. 2.
Figure 8:
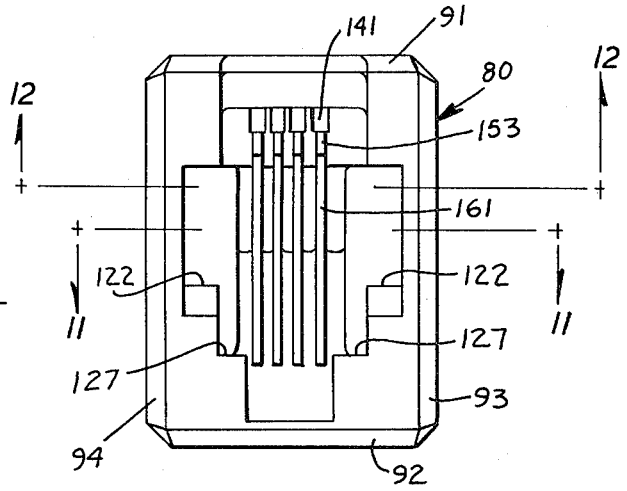
FIG. 8 is a view of an end of the one portion of the coupler jack without the contact elements.
Figure 9:
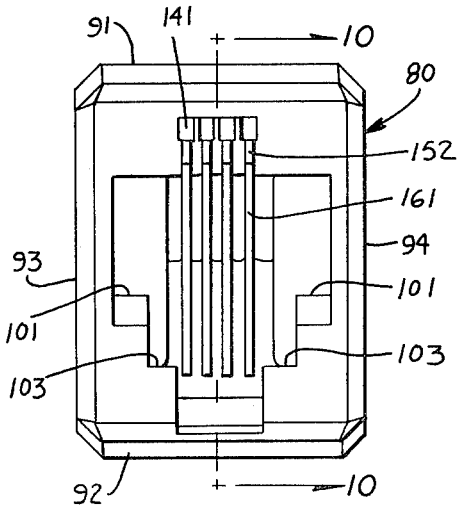
FIG. 9 is an end view of the opposite portion of the coupler jack without the contact elements.
Figure 5:
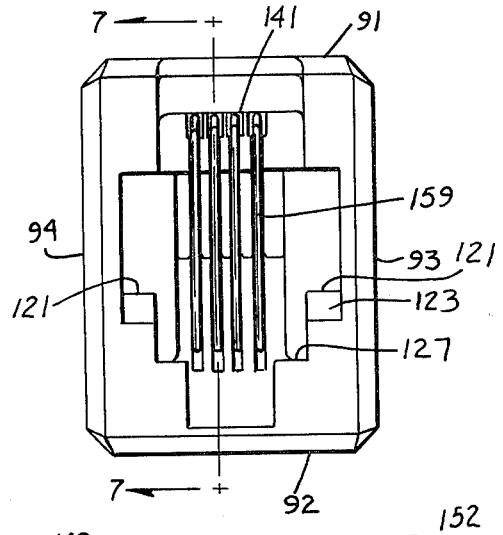
FIG. 5 is an end view of one end portion of the coupler jack which is at the left as viewed in FIG. 4.

Going now to FIGS. 2-3, there is shown in detail the construction of the modular plug 24 which is used to terminate each end of a telephone cord 29 of this invention and which is used to terminate each end of the retractile cord 23 and each end of the line cord 26. It should be observed that the cord which is shown in FIG. 2 is the tinsel cord 26. The plug 24 includes a body 41 which in a preferred embodiment is a unipartite rigid housing designed to be constructed in one molded piece from a plastic material by using conventional injection molding techniques. Plastic material must provide suitable mechanical strength as well as adequate electrical insulation and may be, for example, polycarbonate, a polyester, a polymer or related polymer material such as ABS resin or a rigid polyvinyl chloride (PVC). The housing 41 which could also comprise two mating portions which are assembled and bonded together includes a closed free end 42, a cord input flared aperture 45, a terminal receiving side 44, a side 46 which is opposite to the terminal receiving side and two lateral surfaces 43—43.

The aperture 45 opens to a cavity 47 which terminates adjacent a transition section which connects the cavity to a plurality of conductor receiving channels 49—49. The conductor-receiving channels 49—49 are constructed to include a plurality of individual duct-like compartments or cells with each cell being adapted to receive one conductor. For use with a flat cord, the cells are disposed in one tier and are accessible from the terminal-receiving side of the housing 41. The plug body is also constructed with strain relief portions 55 and 58 for securing the jacket and the individual conductors of the telephone cord within the housing 41.

Each of a plurality of terminal receiving slots 51—51 is parallel to, aligned with and communicates with an associated one of the conductor-receiving channels 49—49. Moreover, each of the slots 51—51 has a length which is slightly less than the out-to-out distance of the portion of a terminal 60 which is to be received therein. Each slot 51 also opens to a well 56 (see FIG. 3) having a plurality of fins 57—57 outstanding therefrom. The intersection of the slots 51—51 and the well 56 are formed with camming surfaces 59—59.

As can be seen in FIG. 2, each one of the terminals 60—60, which is made from an electrically conductor resilient material such as Phosphor bronze, has a flat conductive portion 61 with at least one contact or insulation—piercing tang 62 protruding therefrom to provide an electrical connection between the conductive portion of the conductors and associated ones of the terminals. Each of the blade-like terminals 60—60 also has an edge surface 63 having curved crowns 64—64 with that crown which is nearest the free end of the housing functioning to complete the connection between the associated conductor of the cord and an associated contact element within the coupler jack 30.

Provisions which are made for seating the terminals 60—60 within the associated terminal receiving slots 51—51 include shoulders 66—66 and barbs 67—67 which are formed on each terminal 60 to penetrate the dielectric material which defines a slot and anchor the terminal. Also, the tangs 62—62 extend through the aligned conductor and become embedded slightly in the bottoms of the conductor receiving facilities of the plug body 41. This supplements the side support of the terminals 60—60 in the body 41 to prevent unintended movement of the terminals.

The conductor-receiving cells and the associated terminal-receiving facilities must be constructed within certain restrictions consistent with the dimensions of the coupler jacks and the cords. The spacing of the contact elements of the coupler jack 30, the size of the opening into which the plug is inserted and the external diameter of the insulated conductors 36—36 are standard dimensions which are used throughout the industry. Because of the partitions which define the cells adjacent to the free end of the plug body 41 to provide optimum dielectric strength, the lateral spacing of the conductors which are held in alignment with the terminal receiving slots 51—51 is greater than that between the centerlines of adjacent ones of the external contact elements. The camming surfaces 59—59 (see FIG. 3) are effective in reorienting the terminals which are fed to an insertion position at a predetermined spacing. They cause the terminals to be seated within the plug body so as to be engagable by external components which are spaced apart a predetermined distance and to engage insulated conductors spaced apart a distance other than the predetermined distance.

Formed integrally with the body 41 is a resilient locking tab 70 (see again FIG. 2). The locking tab 70 is molded with a generally flat portion 71 which is connected by a plastic hinge 72 to a nose 69 which extends beyond the free end 42 of the body 41. A free end of the tab 70 extends about 0.15 cm beyond the cord-input end of the plug body 41 when the tab is in its non-depressed position. The nose 69 has a width which is less than that of the plug body 41 and is spaced from the side surfaces 43—43 by stepped recesses 75—75 having free end facing surfaces 76—76. The tab 70 is molded so that the longitudinally axis is oriented at an approximate angle of 15° with respect to the plane of the side 46 of the body 41. Portion 71 is stepped to form shoulders 73—73 having vertical latching surfaces 74—74 that are joined to flats 78—78 along edges 79—79. The combined height of the plug body 40 and the thickness of the locking tab 70 as well as its resiliency permits the insertion of the plug into a coupler jack 30 or a jack 25 between opposing surfaces of either.

Before going on to describe the coupler jack 30, it is of interest to describe the cooperation between the plug body 41 and surfaces of a jack cavity into which the plug is inserted. Tab 70 can be deflected toward the underside of the body 41 to form an arcuate shape so that the side 46 of the plug 24 can be moved slidably in engagement with side ledge surfaces of a jack cavity into which the plug is inserted and with the shoulders 73—73 moved slidably in engagement with other side ledge surfaces which define the cavity. Those side ledge surfaces along which the shoulders ride are interrupted so that just prior to full insertion of the plug 24, portions of the shoulders 73—73 clear those ledges, allowing the arched tab 70 to resume its original molded shape and orientation because of its resilience. Return of the tab 70 to its originally molded shape and orientation causes the free end of the tab to be urged downwardly to its normal undeflected position and be entrapped between vertical surfaces which define the interrupted portions of the ledge surfaces along which the shoulders 73—73 ride. Portions of the coupler shown in copending commonly assigned application Ser. No. 06/081,604 which was filed on Oct. 3, 1979 in the name of E. C. Hardesty and which issued as U.S. Pat. No. 4,268,109 cooperate with the tab 70 in order to hold the plug 24 in the coupler and assure integrity of the connection during customer use. The free end of the tab 70 extends beyond the end-face of the body 41 and the conventional jack (see right-hand portion of FIG. 15). This permits customer depression of the tab 70 in order to cause portions of the shoulders 73—73 to clear the vertical surfaces which define the ledge surface interruptions so that the shoulders can be moved along those ledge surfaces to allow the customer to withdraw the plug from the coupler of application Ser. No. 06/081,604 or from a conventional jack.

The cord 29 of this invention is used when a customer wishes to position the telephone set 20 in a location farther from the wall outlet 28 than the present location of the telephone set. The new location, which indeed could be in another room, may require a line cord 26 having a length which is greater than any one of several conventionally manufactured lengths. This problem is overcome by removing the plug end of the line cord 26 from the wall outlet 28 and inserting it into the shallow cavity or smaller, visually identifiable end of a coupler jack 30 of a cord 29 which is made in accordance with this invention. A plug 24 at one end of a length of cordage which preferably is made from stranded wire or other low resistance cordage and which in combination with the other line cord of the telephone set will provide a suitable length, has been preinserted and locked into a deeper cavity, in the enlarged other end of the coupler jack 30. Then the other end of the cord 29 which is terminated with a plug 24 is inserted into the wall outlet 28 with the telephone set in its new location connected to the wall outlet. The use of a stranded length of cordage 29 with a coupler jack 30 locked to one end thereof in accordance with this invention permits the optimal combination of tinsel set cords with stranded wire cords, for example, having a lowered resistance, which avoids the reduction of signal strength and preserves the quality of service.

As can be seen in FIGS. 4, 5 and 6–10, the coupler 30 includes a housing 80 having a first, small end designated generally by the numeral 83, a second, enlarged end designated generally by the numeral 84, and a plurality of metallic contact elements 85—85. The contact elements 85—85 may be made from a material such as, for example, Phosphor bronze. The housing 80 is made from a dielectric material such as, for example, polycarbonate or rigid polyvinyl chloride (PVC). The first and second end portions 83 and 84 are configured to provide a pair of back-to-back jack cavities 87 and 88, respectively, which function as do the wall jacks or the jacks in the telephone set to receive modular plugs.

Figure 7:
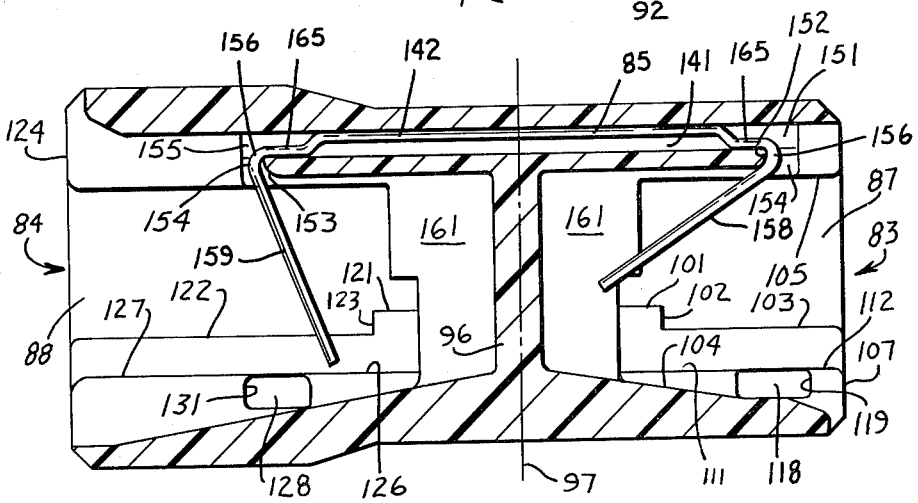
FIG. 7 is a side elevational view of the coupler jack of FIG. 5 taken along lines 7—7 thereof and showing the externally communicating cavity at one end being deeper than the one at the other end with the housing being enlarged at the one end thereof for customer identification of the shallow cavity.
Figure 6:
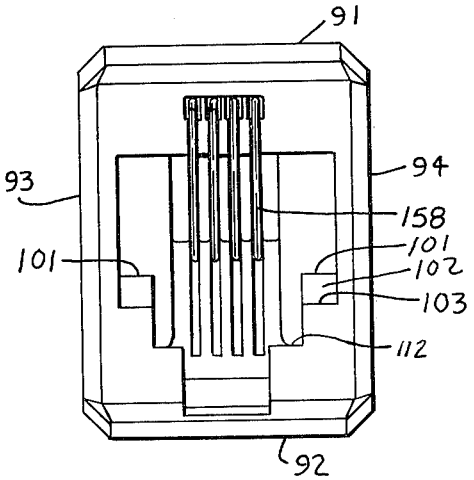
FIG. 6 is an end view of another portion of the coupler.

The housing 80 of the coupler 30 of the cord of this invention further includes a cover 91, and a base 92 which are joined together by sidewalls 93 and 94 and an internal partition 96. As is seen in FIG. 7, the coupler 30 is non-symmetrical about a vertical axis 97 which extends through the partition 96. The non-symmetry occurs not only because of the cavity 88 having a greater depth than the cavity 87 but also because the cover 91 and the base 92 are enlarged at the end 84. The enlargement of those portions advantageously identifies the opposite end of the coupler jack 30 which has the shallow cavity 87 into which the customer inserts the plug end of the line cord 26 that has been removed from the wall outlet.

As for the end 83, the sidewalls 93 and 94 are formed to include an abutment 101 having a vertical face 102. The vertical face 102 intersects a first ledge 103 which extends to the open end of the cavity 87. A second ledge 104 which is closer to an outwardly facing surface 106 of the base 92 than the ledge 103 extends from the partition 96 to a surface 107 to which the cavity 87 opens. A ceiling 105 is spaced from the ledges 103—103 a distance (see FIG. 10) which is substantially equal to the distance between the surfaces 44 and 46 of the plug body 41.

A coupler jack for telephone cords such as that shown in hereinbefore-identified U.S. Pat. No. 4,268,109 and a jack such as is shown in priorly identified U.S. Pat. No. 3,990,764 includes an undercut ledge for allowing the resilient clip or a locking tab 70 which is depressed during insertion of a modular plug 24 to spring return to a normal position. This undercut is moldable since that coupler includes two portions which are joined together to form the coupler while the jack cavity is open from each end to allow suitable access of molding tools. Hence, each portion has what will become an interior portion of the coupler and is exposed for access by molding core pins. Such exposure is also available in modular jacks such as the one disclosed and claimed in C. L. Krumreich U.S. Pat. No. 3,990,764.

The molding of the coupler jack 30 of the cord 29 of this invention is not so straightforward. Since it will be recalled, an object of this invention is to provide a coupler jack having a unipartite housing which is substantially less costly than one made of two portions and which facilitates mechanization, access to the interior becomes a problem. And yet, provisions must be made for allowing the tab 70 of a plug 24 which is inserted into the coupler to return to its normal non-depressed condition to lock the plug in the coupler.

Figure 10:
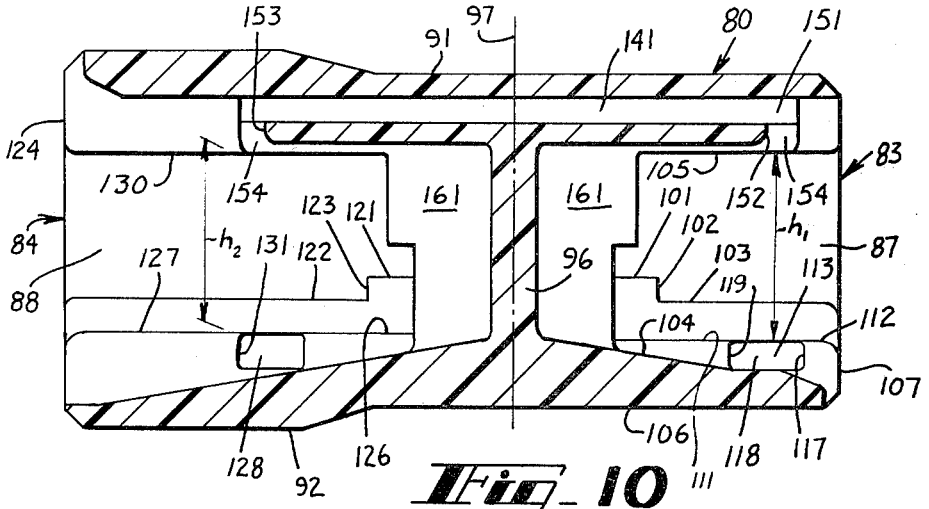
FIG. 10 is a side elevational view of the coupler jack of FIG. 9 and taken along lines 10—10 thereof.
Figure 11:
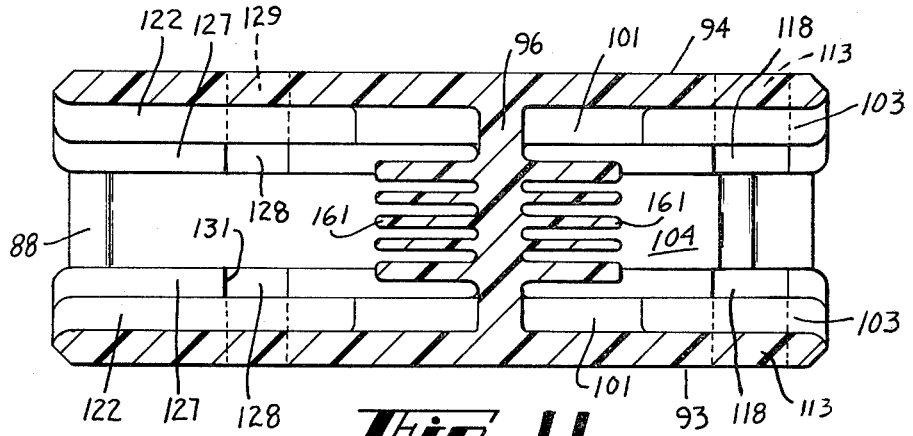
FIG. 11 is a plan view in section of a portion of the coupler jack of FIG. 10.

In order to allow the locking tab 70 of the modular plug 24 to assume a non-depressed, normal position during insertion, each sidewall 92 and 93 of the housing 80 is formed to include a third ledge 111 (see FIGS. 7 and 10). The distance from the ceiling 105 to the ledges 111—111 is designated "$h_1$". Each ledge 111 is interrupted by an opening 113 having a rectangular cross-section and extending from an exterior surface of the wall 92 and from an exterior surface of the sidewall 93 into the cavity 87. The ledges 111—111 are connected to the external surface 107 through portions 112—112. Of course, if the housing 80 was assembled from mating portions, the ledge construction could be made without use of the openings 113—113.

Figure 14:
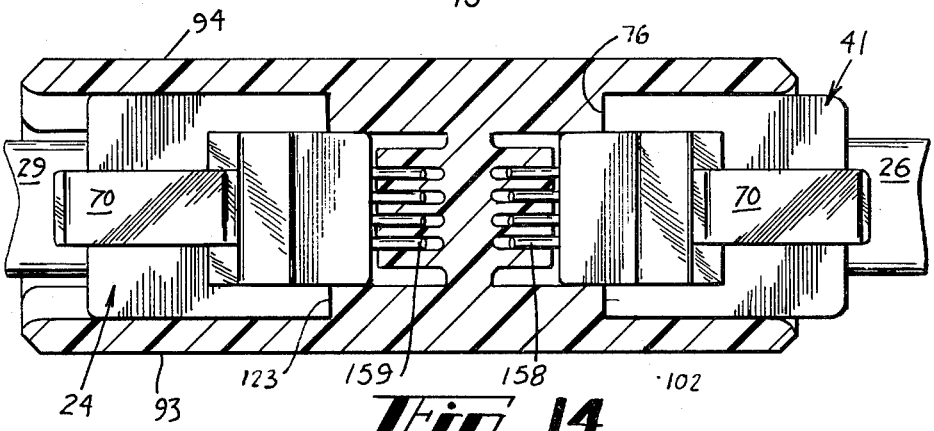
FIG. 14 is a plan view in section of the coupler jack in FIG. 13 with a plug inserted into each cavity thereof and taken along lines 14—14.

This structural arrangement facilitates the lock-in of the modular plug 24 in the cavity 87. When a modular plug 24 is inserted into the cavity 87 (see FIGS. 14–15), the tab 70 thereof is depressed and bent and has an arched configuration as the flats 78—78 of the shoulders 73—73 engage and ride along the ledge portions 112—112. At the same time, the side 46 of the plug body 41 is moved slidably along surfaces 103–103 of the cavity 87. The inward movement of the plug body 41 is discontinued when the vertical surfaces 76—76 of the recesses 75—75 engage the surfaces 102—102 that extend between the ledges 101—101 and 103—103. As the shoulders 73—73 of the plug tab pass vertically oriented surfaces 117—117, the resilience of the tab causes it to move pivotally downward to cause the shoulders to become entrapped in the interrupted portions 118—118 of the sidewalls between the ledges 111—111 and their continuations 112—112. This arrangement resists withdrawal of the plug from the coupler jack becomes of the engagement of the vertical surfaces 74—74 of the tab of the plug with the vertical surfaces 117—117 which define the portions 118—118.

Figure 15:
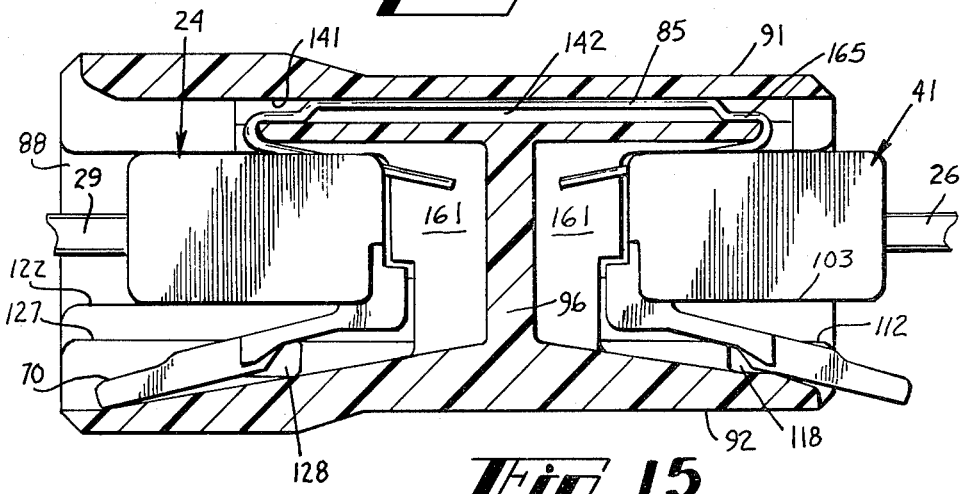
FIG. 15 is a side elevational view partially in section of the coupler jack shown in FIG. 13 with a modular plug of a cord received in each cavity.

As should be obvious from a perusal of the drawings, especially FIG. 15 thereof, the end 83 of the coupler 30 is designed to receive a modular plug are to hold the plug such that a customer can easily remove it if desired. The free end of the tab 70 of the plug extends beyond the surface 107—107 of the plug to permit its digital depression by a customer so that it reassumes the arched configuration of entry. The cavity 87 is formed so that with the plug body 41 in proximate engagement with the ceiling 105 and the ledges 103—103, the depression of the tab 70 moves the shoulders 73—73 a distance so that the flats 78—78 are disposed substantially at the level of the surfaces 112—112 to permit withdrawal of the plug.

Going now to the opposite end 84 of the housing 80, there are provisions for receiving a modular plug 24 as in the end 83. Moreover, the end 84 includes provisions for locking the plug within the cavity 88 and preventing convenient withdrawal of the plug. The retention of the plug in the deeper cavity 88 of the coupler jack 30 is not intended to be easily manipulated by a customer without mechanical assistance. This allows each end of a length of cordage to be terminated with a modular plug with the plug at one end then inserted into a cavity 88 of a coupler jack 30 to form an extension cord having a coupler jack at said one end.

As can be seen in FIGS. 5, 7–8 and 10–11, the sidewalls at the end 88 are formed to include a plateau 121 which is joined to a ledge 122 through a riser 123 which functions as a stop for the plug 24 during insertion. The ledge 122 extends to a surface 124 with which the cavity 88 communicates. Each sidewall 94 and 93 also includes a lower ledge 126 having a portion 127 adjacent to the outer surface 124. The lower ledge 126 which is formed on each sidewall is interrupted by a cutout 128 which is formed by an opening 129 (see especially FIG. 11) that has a rectangular cross-section and that extends through each sidewall. This structural arrangement is easily moldable with a core pin (not shown) extending from an outer surface of each sidewall 93 and 94 to the cavity 88.

Figure 13:
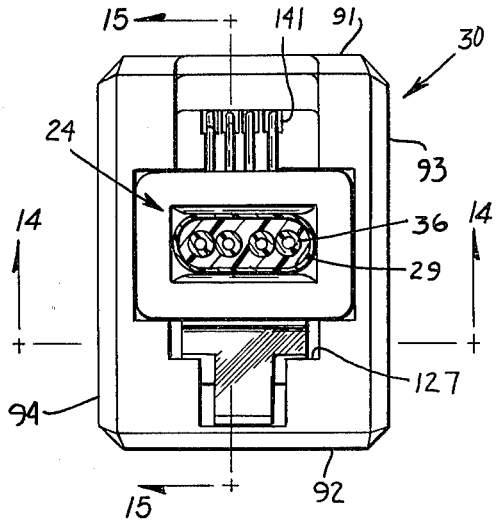
FIG. 13 is an end view of the left portion of the coupler jack as viewed in FIG. 4 with a plug inserted into the cavity of that portion.

The end 84 facilitates the initial lock-in of the plug 24 in much the same manner as in the cavity 87. When the plug 24 is inserted into the cavity 88 (see FIGS. 13–15) and moved inwardly, the plug body 41 is moved along the ledges 122—122 while the flats 78—78 of the locking shoulders of the tab move along the ledges 127—127. This, of course, depresses the tab 70 toward the plug body 41. However, once the flats 78—78 of the shoulders 73—73 have been moved past surfaces 131—131 that define the interruptions 128—128 of the ledges 127—127, which occurs just before the surfaces 76—76 of the plug body 41 engage the stop surfaces 123—123, the tab 70 is allowed to be resiliently returned to its normal undepressed condition. The shoulders 73—73 of the tab 70 are disposed face-to-face with the vertical portions 131—131 of the ledges 127—127. These opposing surfaces engage each other to lock in the plug against withdrawal when the plug is subjected to retrograde forces. Further inward movement of the plug 24 and overtravel of the latching surfaces 74—74 from the surfaces 131—131 of the interruptions 128—128 causes the plug to engage the stop surfaces 123—123.

As will be observed in FIGS. 7 and 10, the end 84 unlike the end 83 is arranged to prevent facile removal of the plug 24. This is accomplished by having a substantially deeper cavity 88 than the cavity 87 so that when the plug 24 is inserted into the cavity in the end 84, the locking tab 70 does not extend to the surface 124. Hence, the customer cannot remove the plug 24 by digital depression of the tab 70 and, in fact, must use some form of a mechanical assist.

Figure 16:
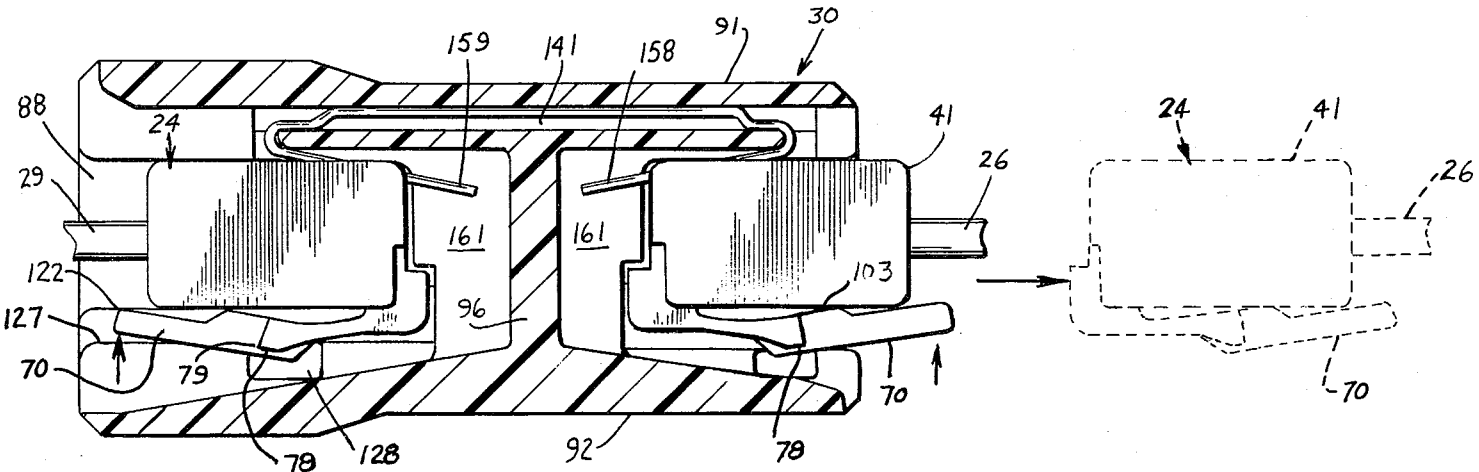
FIG. 16 is an elevational view of the coupler jack in section with a plug in each of the opposed cavities and showing the application of forces to the ends of the plug tabs and the configuration of the tabs which allows withdrawal from the cavity in the right hand one of the cavities.

Not only is the depth of the cavity 88 important to the prevention of the facile withdrawal of a plug 24 therefrom, but the configuration of those portions which engage the tab side of the plug as well as a distance $h_2$ (see FIG. 10) between the ledges 127—127 and ceiling portions 130—130 contribute to this feature. Going now to the right-hand portion of FIG. 16, there is shown the conventional jack cavity 87 with the plug 24 disposed therein. When the tab 70 is depressed as is shown in FIG. 16, it is seen that it arches along its hinge portion 72 with the flats 78—78 being spaced slightly above the ledges 112—112. When the user applies a retrograde force to the plug, the flats 78—78 are capable of being moved along the ledges 112—112 to allow withdrawal.

Figure 17:
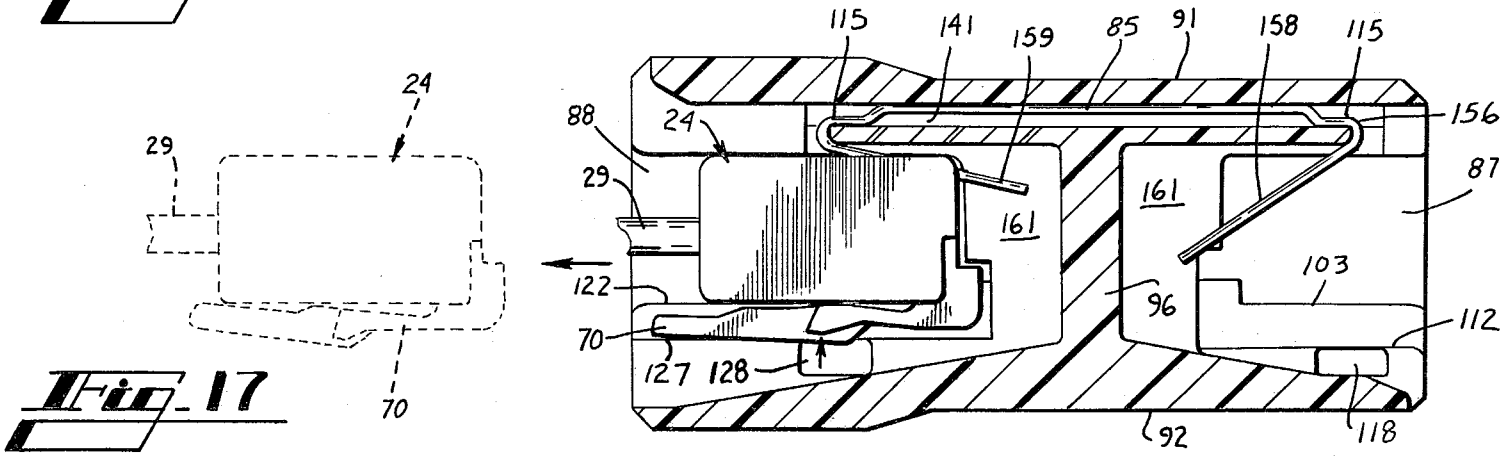
FIG. 17 is an elevational view in section of the coupler jack with a plug in the deeper, left one of the two cavities having its tab depressed to a predetermined configuration to facilitate its withdrawal.

The configuration and dimensions of the cavity 88 of the coupler jack 30 of this invention do not permit such facile withdrawal. The distance $h_2$ between the ceiling 130 of the cavity 88 and the ledges 127—127 has been decreased so that when the tab 70 is depressed at its free end and pivoted about its fulcrum point to form an arched configuration such as that shown to the left in FIG. 16, lower edges 79—79 and flats 78—78 do not clear the edges at the intersections of the ledges 127—127 and the surfaces 131—131 of the interrupted portions 128—128. In fact, in order for them to clear the ledges, it is required that an extremely thin flat blade-like tool be inserted into engagement with the tab 70 and forces applied thereto such that the tab assumes a particular configuration. To withdraw the plug from the cavity 88, forces are applied to the tab 70 in the vicinity of the shoulders 73—73 (see FIG. 17). These forces are sufficient to substantially flatten the tab against the underside 46 of the plug body so that the tab no longer has an arched configuration but rather a substantially linear one and so that it will clear the ledges.

As can be seen in FIGS. 5–7 and 13–15, the housing 80 is formed to include a plurality of passageways 141—141 each of which is adapted to receive a center portion 142 of one of a plurality of the contact elements 85—85. The passageways 141—141 communicate with the cavities 87 and 88 through openings which are recessed from the surfaces 107 and 124 of the housing 80 to which the cavities open.

The cover 91 of the housing 80 is formed to have a recessed portion 151 having a surface 152 in the end 83 and a recessed portion 155 in the end 84 housing a surface 153 in the end 84. The passageways 141—141 open to the surfaces 153 and 152 so that the contact elements 85—85 extend below those surfaces but have their end portions still within the cavities 87 and 88.

Figure 12:
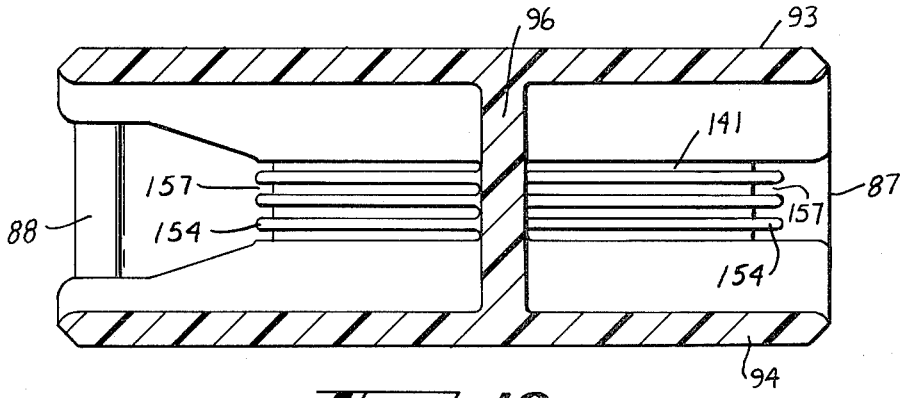
FIG. 12 is a plan view in section of an underside of one portion of the coupler jack of FIG. 10.

A plurality of ribs 154—154 (see also FIGS. 10 and 12) which extend from the surfaces 152 and 153 are designed to prevent any turning of the contact elements 85—85 once their end portions are formed into the retroflexed configurations around the surfaces 152 and 153. As can be seen best in FIGS. 5–6, 12 and 14–15, the portions 154—154 which extend from the surfaces 152 and 153 form a plurality of grooves 157—157 each of which receives a transition portion 156 of a contact element 85 that connects the center portion 142 (see FIG. 7) with one of its retroflexed end portions.

The end portions of the contact elements 85—85 are specially formed to facilitate their engagement by terminal blades 60—60 of a modular plug 24 which is inserted into each cavity. As is seen in FIG. 7, one end portion of each contact element 85 is formed into a retroflexed configuration 158 in the cavity 87 and one into a portion 159 in the cavity 88. When a modular plug 24 is inserted into either or both of the cavities 87 or 88 so that its free end 42 engages the surface 102 in the cavity 87 or the surface 123 in the cavity 88, the fins 57—57 (see FIG. 3) formed on the plug cause the retroflexed portions 158—158 or 159—159 of the contact elements 85—85 to remain separated and to be guided into engagement with corresponding ones of the terminals 60—60.

As can be seen in FIG. 7, the housing 80 is formed preferably to include a plurality of partitions 161—161 that are spaced apart and that extend from the center wall 96 and from the top 91 into the cavities 87 and 88. The partitions 161—161 are spaced apart to coincide with the spacing of the fins 57—57 on the plug body 41 and such that the retroflexed end portions 158—158 and 159—159 of the contact elements are received therebetween.

The partitions 161—161 enhance dielectric breakdown strength for the coupler jack 30. It is well known that the contact elements 85—85 are most vulnerable to high voltage breakdown and arcing in the vicinity of the surfaces 152 and 153 and at their free ends. The potential for dielectric breakdown in the vicinity of the surfaces 152 and 153 is greatly reduced by the portions 154—154 while the partitions 161—161 are effective to reduce that potential at the free ends of the contact elements.

The partitions 161—161 have at least one other important function. They are not necessary to facilitate engagement of terminals 60—60 of an inserted plug because the fins 57—57 on the plug itself cause the free ends of the contact elements 85—85 to be picked up and aligned with the plug terminals. However, the partitions 161—161 do serve to prevent inadvertent damage or deformation which could occur if some object other than a plug were inserted.

This arrangement is advantageous for a number of reasons. First, the construction of the housing 80 as one which is unipartite is a simplification insofar as its manufacture. Also, the arrangement causes each contact element 85 to be steadied and it prevents any torsional stresses from being imparted to the linear portions 142—142 in the passageways 141—141.

In a preferred embodiment of this invention, the linear portion 142 of each of the contact elements 85—85 is formed with an offset portion 165—165 (see FIG. 7) adjacent to each end thereof. Because of the capabilities of molding the passageways for the linear portions, the cross-sectional area of each is substantially larger than that of the contact element 85. This causes problems when attempting to form the retroflexed ends of each contact element after it has been inserted into a passageway 141 and may result in undesired movement. The formation of the contact element 85 with the offsets 165—165 overcomes this problem and the combined height of the linear portion and offset is about equal to the height of the passageway 141 which causes the contact element to be generally secured against unintended longitudinal and vertical movement.

It should be understood that while the preferred embodiment of this invention includes a length of cordage 29 which is terminated with a plug at each end and with one of the plugs received and secured within a cavity 88 against unintended withdrawal of a coupler jack 30, other embodiments are within its contemplation. For example, each end of the cord 29 could be provided with a coupler jack 30, or each of the two opposed cavities of the coupler jack may be identical so as to make the coupler jack symmetrical about the axis 97.

It is to be understood that the above-described arrangements are simply illustrative of the invention. Other arrangements may be devised by those skilled in the art which will embody the principles of the invention and fall within the spirit and scope thereof.

What I claim is:

1. A modular cord having connectorized ends, said cord comprising:

a length of cordage which comprises a plurality of individually insulated conductors which are enclosed in a jacket of plastic material;

a modular plug which terminates each end of said length of cordage, said plug comprising a body, a plurality of terminals mounted in said body and a resilient tab having one end connected to said body, a free end, and a pair of oppositely extending locking shoulders spaced from said free end, said tab in a normal orientation extending obliquely outwardly from said plug body; and a coupler jack which is connected to one of said modular plugs which terminate said length of cordage, said coupler jack comprising:

a housing which includes two modular plug-receiving cavities each communicating with an associated external surface of said housing, a plurality of passageways that extend between and communicate with said cavities, and means formed within each of said cavities for cooperating with said oppositely extending shoulders of the tab of a plug that is received in each of said cavities for locking the plug within the housing when the plug tab is in said normal orientation, said one plug which terminates an end of said length of cordage being disposed in one of said cavities with at least said one of said cavities extending sufficiently inwardly from its associated external surface to cause the free end of the tab of a plug received in said one cavity to be within said one cavity and spaced from its associated external surface a distance which is sufficient to prevent facile unlocking and withdrawal of said one plug from said housing; and a plurality of wire-like contact elements each having a linear portion which is positioned in one of said passageways and retroflexed end portions which are positioned in said cavities and which are adapted to be engaged by terminals of modular plugs that are inserted into said plug-receiving cavities.

2. The cord of claim 1, wherein said means formed within said housing for locking a plug within said housing includes means formed in said at least one of said cavities for preventing withdrawal of said plug from said at least one cavity until said tab of said plug in said at least one cavity has been caused to assume a predetermined orientation with respect to said body of said plug.

3. The cord of claim 2, wherein said predetermined orientation of said tab is one in which said tab is caused to assume a substantially linear configuration substantially parallel to an outwardly facing surface of said plug.

4. The cord of claim 1, wherein said housing of said coupler jack is unipartite.

5. The cord of claim 2, wherein each said cavity of said housing is formed to include opposing first ledges formed as interior surfaces extending from internal side walls which define each said cavity, said first ledges on opposed sidewalls supporting the body of a modular plug when said plug is inserted into each said cavity, said housing also being formed to have a second ledge on each of said sidewalls of each cavity to engage shoulders of a tab of a modular plug which is inserted into each said cavity to depress said tab, said second ledge on each side of each said cavity being interrupted by an opening that extends through said sidewall and communicates with an external side surface of said housing.

6. The cord of claim 5, wherein said second ledges of each said cavity are formed relative to said first ledge and to the plug body so that after the shoulders of a tab of a plug are aligned with said interrupted portions of said second ledges said tab is allowed to return resiliently to its normal non-depressed condition with said shoulders becoming disposed within said interrupted portions.

7. The cord of claim 6, wherein said second ledges of said at least one cavity are spaced from a ceiling of said one cavity a distance which prevents clearance of said shoulders of said tab of said one plug from said second ledges when said free end of said tab is depressed toward said plug body without the application of forces to said tab in the vicinity of said shoulders.

8. The cord of claim 7 wherein said second ledges of said at least one cavity are spaced from said ceiling of said at least one cavity a distance such that said tab of said one plug which is received in said at least one cavity must be reoriented to be substantially adjacent to said plug body along substantially its entire length to permit withdrawal.

9. The cord of claim 1, wherein said housing also includes a partition which separates said one cavity from the other cavity.

10. The cord of claim 1, wherein said two cavities of said housing of said coupler jack are opposed to each other and said housing is formed with one of said cavities extending inwardly farther from its associated external surface than the other one of said cavities from its associated external surface.

11. The cord of claim 10, wherein the other one of said opposed cavities extends from an associated external face inwardly a distance such that when a plug is received therein such that the tab of the plug is returned to its normal orientation, at least a free end portion of the tab extends beyond said associated external surface to which said other cavity opens.

12. The cord of claim 10, wherein said portion of said housing in which said one cavity is formed is enlarged to facilitate customer identification of the portion of the housing in which said other cavity is formed.

13. The cord of claim 1, wherein said coupler housing is formed to include a plurality of spaced partitions which extend into each of said cavities with retroflexed end portions of said contact elements being received therebetween.

14. A coupler jack for connectorizing an end of a cord that is terminated with a modular plug having a resilient tab which includes one end connected to a body of the plug, a free end and a pair of oppositely extending shoulders spaced from the free end, and which in a normal orientation extends obliquely from the body, said coupler jack comprising:

a housing which includes two modular plug-receiving cavities each communicating with an associated external surface of said housing, a plurality of passageways that extend between and communicate with said cavities, and means formed within each of said cavities for cooperating with the oppositely extending shoulders of the tab of a plug that is received in each of said cavities for locking the plug within the housing when the tab is in its normal orientation with at least one of said cavities exending sufficiently inwardly from its associated external surface to cause a free end portion of the tab of a plug received in said one cavity to be within said one cavity and spaced from its associated external surface a distance which is sufficient to prevent facile unlocking of said tab and withdrawal of the plug from said one cavity; and a plurality of wire-like contact elements each having a linear portion which is positioned in one of said passageways and retroflexed end portions which are positioned in said cavities and which are adapted to be engaged by terminals of modular plugs which are inserted into said plug-receiving cavities.

15. The coupler jack of claim 14, wherein said means formed within said housing for locking a plug within said housing includes means formed in said at least one of said cavities for securing the plug within said at least one cavity until the tab of the plug in said at least one cavity is caused to assume a predetermined orientation with respect to the body of the plug.

16. The coupler jack of claim 15, wherein said predetermined orientation of the tab is one in which the tab is caused to assume a substantially linear configuration substantially parallel to an outwardly facing surface of the plug.

17. The coupler jack of claim 15, wherein said housing is unipartite.

18. The coupler jack of claim 15, wherein each said cavity of said housing is formed to include a first ledge formed on an interior surface of opposing internal sidewalls which define each said cavity, said first ledges on opposed sidewalls supporting the body of a modular plug when a plug is inserted into said each cavity, said housing also being formed to have a second ledge on each of said sidewalls to engage shoulders of the tab as the plug is inserted into said cavity to depress the tab, said second ledge on each side of each said cavity being interrupted by an opening that extends through said sidewall and communicates with an external side surface of said housing.

19. The coupler jack of claim 18, wherein said second ledges are formed relative to said first ledges and with respect to the plug body so that after the shoulders of the tab of a plug are aligned with said interrupted portions of said second ledges the tab is allowed to return resiliently to its normal non-depressed condition with its shoulders being disposed within said interrupted portions.

20. The coupler jack of claim 18, wherein said second ledges are spaced from a ceiling of said one cavity a distance such that the tab of a plug which is received in said one cavity must be deformed to be substantially adjacent to the plug body along substantially its entire length to permit withdrawal.

21. The coupler jack of claim 14, wherein said two cavities are opposed to each other and said housing of said coupler jack is formed with one of said cavities extending inwardly from its associated external surface farther than the other one of said cavities from its associated external surface.

22. The coupler jack of claim 21, wherein the other one of said opposed cavities extends from an associated external face inwardly a distance such that when a plug is received therein such that a tab of the plug is returned to its normal orientation, at least a free end portion of the tab extends beyond said associated external face to which said other cavity opens.

23. The coupler jack of claim 21, wherein said portion of said housing in which said one cavity is formed is enlarged to facilitate customer identification of the portion of the housing in which said other cavity is formed.

24. The coupler jack of claim 14, wherein said coupler housing is formed to include a plurality of spaced partitions which extend into each of said cavities with retroflexed end portions of said contact elements being received therebetween.

25. The coupler of claim 14, where said housing also includes a partition which separates said one cavity from the other cavity.

26. A housing for a coupler jack for connectorizing an end of a cord which is terminated with a modular plug having a resilient tab which includes one end formed integrally with a body of the plug, a free end and a pair of oppositely extending shoulders spaced from the free end, and which in a normal orientation extends obliquely from the body of the plug, said housing comprising two modular plug-receiving cavities each communicating with an associated external surface of said housing, a plurality of passageways that extend between and communicate with said cavities, and means formed within each one of said cavities for cooperating with the oppositely extending shoulders of the tab of a plug that is received in each of said cavities for locking the plug within the housing when the tab is in its normal orientation with at least one of said cavities extending inwardly from its associated external surface sufficiently to cause the free end portion of the tab of a plug received in said one cavity to be within said one cavity and spaced from its associated external surface a distance which is sufficient to prevent facile unlocking of the plug in said one cavity from said housing.

27. The housing of claim 26, wherein said means formed within said housing for locking a plug within said housing includes means formed in said at least one of said cavities for securing the plug within said at least one cavity until the tab of the plug in said at least one cavity is caused to assume a predetermined orientation with respect to a body of the plug.

28. The housing of claim 27, wherein said predetermined orientation of the tab is one in which the tab is caused to assume a substantially linear configuration substantially parallel to an outwardly facing surface of said plug.

29. The housing of claim 26, wherein said housing is unipartite.

30. The housing of claim 26, wherein said housing is formed to include a first ledge formed on an interior surface of opposing internal sidewalls which define each said cavity, said first ledges on opposed sidewalls supporting the body of a modular plug when the plug is inserted into said one cavity, said housing also being formed to have a second ledge on each of said sidewalls to engage shoulders of the tab as the plug is inserted into said each cavity to depress the tab, said second ledge on each side of each said cavity being interrupted by an opening that extends through said sidewall and communicates with an external side surface of said housing.

31. The housing of claim 30, wherein said second ledge is formed relative to said first ledge and with respect to a ceiling of each cavity of said housing so that after the shoulders of the tab of said plug are aligned with said interrupted portions of said second ledges the tab is allowed to return resiliently to its normal non-depressed condition with the shoulders being disposed within said interrupted portions.

32. The housing of claim 31, wherein said second ledges are spaced from a ceiling of said one cavity a distance such that the tab of a plug which is received in said one cavity must be reoriented to be substantially adjacent to the plug body along substantially its entire length to permit withdrawal.

33. The housing of claim 26, wherein said two cavities are opposed to each other and said housing is formed with one of said cavities extending inwardly from its associated external surface farther than the other one of said cavities from its associated external surface.

34. The housing of claim 33, wherein said portion of said housing in which said one cavity is formed is enlarged to facilitate customer identification of the portion of the housing in which said other cavity is formed.

35. The housing of claim 26, wherein said coupler housing is formed to include a plurality of spaced partitions which extend into each of said cavities with retroflexed end portions of contact elements having portions extending through said passageways being received therebetween.

36. The housing of claim 26, where said housing also includes a partition which separates said one cavity from the other cavity.

* * * * *